US008061977B2

(12) United States Patent
Keller et al.

(10) Patent No.: US 8,061,977 B2
(45) Date of Patent: Nov. 22, 2011

(54) CERAMIC MATRIX COMPOSITE ATTACHMENT APPARATUS AND METHOD

(75) Inventors: Douglas A. Keller, Kalamazoo, MI (US); Jay A. Morrison, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1175 days.

(21) Appl. No.: 11/824,796

(22) Filed: Jul. 3, 2007

(65) Prior Publication Data

US 2009/0010755 A1 Jan. 8, 2009

(51) Int. Cl.
*F01D 11/08* (2006.01)

(52) U.S. Cl. ..... 415/173.1

(58) Field of Classification Search ..... 415/173.1, 415/213.1, 214.1

See application file for complete search history.

(56) References Cited

U.S. PATENT DOCUMENTS

| | | | | |
|---|---|---|---|---|
| 4,111,603 | A | 9/1978 | Stahl | |
| 4,245,954 | A | 1/1981 | Glenn | |
| 4,438,626 | A | 3/1984 | Berestecki | |
| 5,358,379 | A | 10/1994 | Pepperman et al. | |
| 5,497,616 | A | 3/1996 | Roberts | |
| 6,648,597 | B1 | 11/2003 | Widrig et al. | |
| 6,670,021 | B2 | 12/2003 | Schroder et al. | |
| 6,709,230 | B2 | 3/2004 | Morrison et al. | |
| 6,758,653 | B2 | 7/2004 | Morrison | |
| 6,896,484 | B2 | 5/2005 | Diakunchak | |
| 2003/0185674 | A1 * | 10/2003 | Alford et al. | 415/173.1 |
| 2004/0047726 | A1 | 3/2004 | Morrison | |
| 2004/0062639 | A1 * | 4/2004 | Glynn et al. | 415/134 |
| 2005/0076504 | A1 | 4/2005 | Morrison et al. | |
| 2005/0158168 | A1 * | 7/2005 | Bruce et al. | 415/173.1 |
| 2006/0292001 | A1 * | 12/2006 | Keller et al. | 415/170.1 |
| 2007/0031258 | A1 * | 2/2007 | Campbell et al. | 416/189 |

* cited by examiner

*Primary Examiner* — Edward Look
*Assistant Examiner* — Aaron R Eastman

(57) ABSTRACT

An attachment method and flange for connecting a ceramic matrix composite (CMC) component, such as a gas turbine shroud ring (36, 68), to a metal support structure. A CMC flange (20A) may be formed by attaching a wedge-shaped block (26) of a ceramic material to a CMC wall structure (22), and wrapping CMC layers (24) of the wall structure (22) at least partly around the block (26), forming the flange (20A) with an inner oblique face (34) and an outer face (35) normal to the wall structure. An adjacent support structure, such as a metal support ring (40A), may abut the outer face (35) of the CMC flange (20A) and be clamped or bolted to the CMC flange (20A).

14 Claims, 5 Drawing Sheets

CERAMIC MATRIX COMPOSITE ATTACHMENT APPARATUS AND METHOD

FIELD OF THE INVENTION

This invention relates to Ceramic Matrix Composite (CMC) attachment methods and mechanisms, particularly for attaching CMC components such as shroud rings or combustor liners to metal support structures in a gas turbine.

BACKGROUND OF THE INVENTION

Gas turbine engines have rotating turbine blades surrounded by a shroud. Each circular array of blades on a rotating turbine disc is closely surrounded by a shroud ring, which may be a full hoop or assembled from arcuate segments. Engine efficiency is proportional to combustion temperature, so modern gas turbines use ceramics in these shroud rings and other components, since ceramics surpass metals in heat tolerance. Ceramic matrix composite (CMC) components are often used, and they must be attached to metal support structures.

A flange is a common device for attaching components together with bolts, and flanges are often satisfactory for metal components. However, CMC has relatively weak interlaminar tensile strength, which can cause weakness at the base of a CMC flange, especially in the cyclical thermal and mechanical stresses of a gas turbine engine environment. Thus, it has been problematic to design durable mechanisms for attaching CMC components to metal structures in gas turbines.

BRIEF DESCRIPTION OF THE DRAWINGS

The invention is explained in the following description in view of the drawings that show.

DETAILED DESCRIPTION OF THE INVENTION

Figure 1:
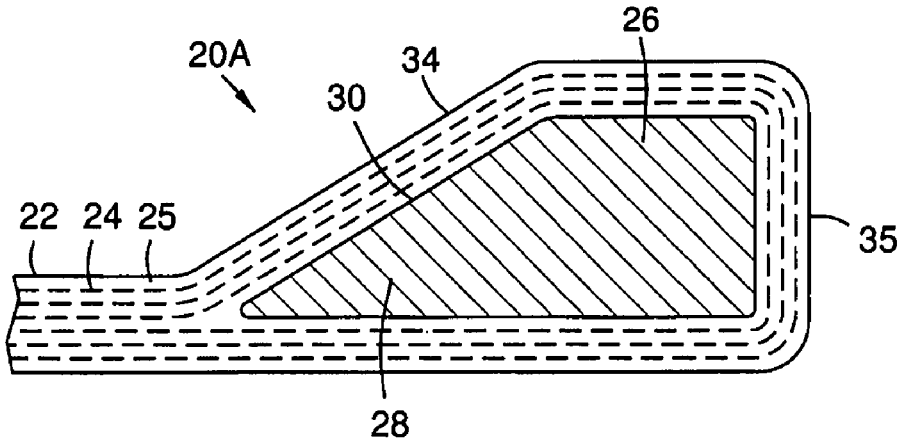
FIG. 1 is a sectional view of an edge of a CMC wall structure with a CMC flange according to an embodiment of the invention.

FIG. 1 shows a sectional view of a CMC flange 20A on an edge of a CMC wall structure 22. The wall structure is composed of one or more layers of CMC fabric 24, such as a ceramic or carbon fabric, impregnated with a ceramic matrix

25 as known in the art. A core block 26 of additional ceramic material with a generally wedge-shaped portion 28 is attached to the CMC wall structure 22. The block has an inner oblique surface 30 relative to the CMC wall structure, where "inner" means proximal to a geometric center of the CMC wall structure. The CMC fabric 24 is wrapped at least partly around the block 26, and is bonded to it. This forms the flange 20A with a solid core 26. The core may be a monolithic ceramic, or it may be built-up from layers of CMC fabric. The CMC fabric 24 of the wall structure may be formed continuously around the block 26 by means of 3-dimensional weaving as in FIG. 1, or it may be wrapped partially around the block in a lay-up process. The resulting flange 20A has an inner face 34 and an outer face 35.

The structure of FIG. 1 provides a mechanism for attachment to a metal support structure that avoids the problematic interlaminar stress concentration that may be typical of a prior art right-angled flange structure. The structure of FIG. 1 presents a compressive contact surface 34 for an attachment apparatus that distributes the attachment load over an area of the CMC structure and that avoids the concentration of interlaminar tensile stresses.

Figure 2:
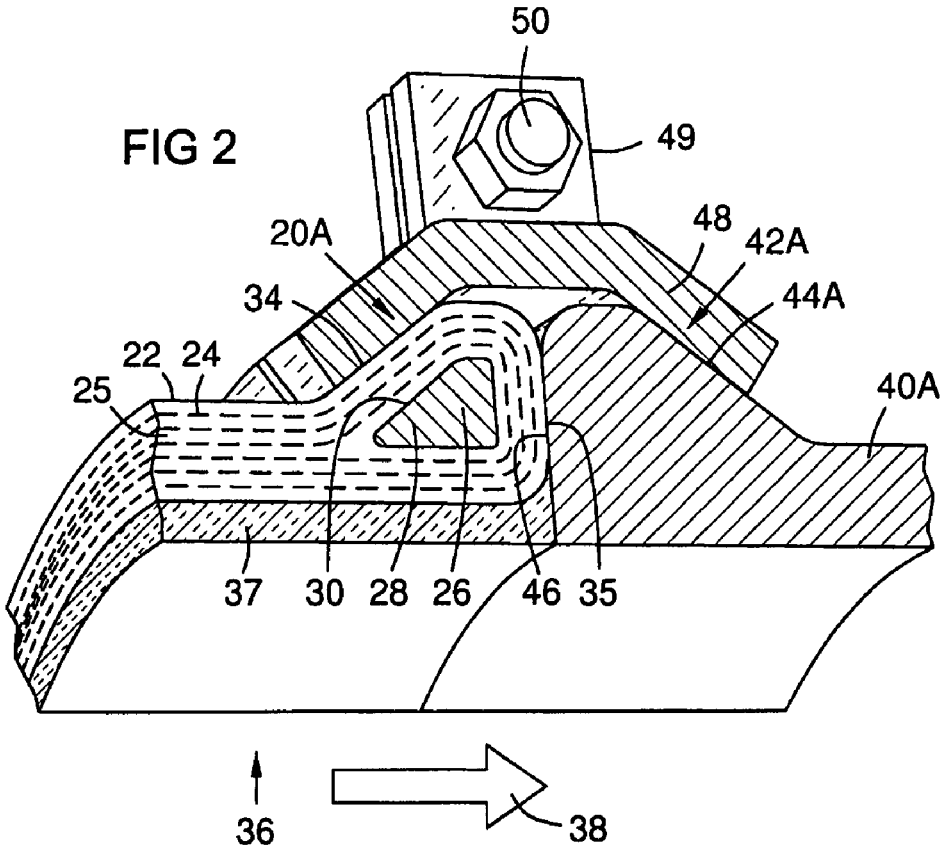
FIG. 2 is a sectional and perspective view of a shroud ring segment with a CMC flange of the embodiment of FIG. 1 attached to an adjacent structure by means of a V-band.

FIG. 2 shows a gas turbine shroud ring segment 36 with a thermal barrier coating 37 providing thermal insulation from a hot combustion gas flow 38. A CMC wall structure 22 on the ring segment 36 has a CMC flange 20A for attachment to an adjacent flange 42A on a hoop-shaped support structure 40A. The adjacent flange 42A has an oblique face 44A that is symmetric with the inner face 34 of the CMC flange about the outer face 35 of the CMC flange. The adjacent structure 40A may be made of a different material than CMC, such as metal. The CMC fabric 24 may span continuously from the wall structure 22 over the inner oblique surface 30 of the block 26, forming the inner face 34, which serves as a first contact face for a circular metal V-band 48. The oblique face 44A on the adjacent structure 40A serves as a second contact face for the V-band. Bosses 49 on the V-band are drawn together by a bolt 50, placing the V-band in tension. This compresses adjacent ring segments 36 against each other end-to-end around the shroud ring, forming a stable ring structure. The general V shape of the band holds the outer face 35 of the ring segment 36 against an outer face 46 of the adjacent structure 40A.

Embodiment 20A and others herein apply to generally cylindrical CMC components such as combustor liners, shroud rings, and transition duct exit mouths. In these components, the CMC wall 22 forms either a ring-shaped structure or a segment in a ring-shaped structure, and is retained radially by virtue of axial-symmetry of radial forces. Clamps 48 and 52 herein provide a radially inward force component against the oblique surfaces 34. This inward force is opposed by compressive resistance in the ring of the wall structure 22. Herein the terms "axial" and "radial" refer to the inherent axis of a cylindrical or ring-shaped component geometry.

Figure 3:
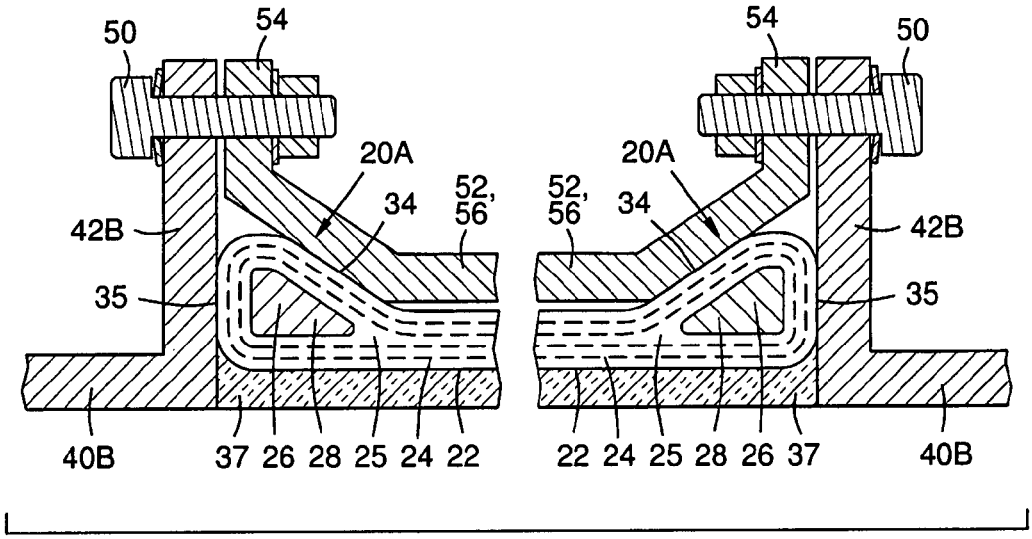
FIG. 3 is a sectional view of a CMC flange of the embodiment of FIG. 1 attached to an adjacent structure by means of a circular clamp plate.

FIG. 3 shows a CMC flange 20A in contact with an adjacent flange 42B of an adjacent structure 40B. The adjacent flange 42B is aligned with the outer face 35. A circular clamp plate 52 has a flange 54 that is parallel to the outer face 35, and a spanning portion 56 that spans to an opposite side of the wall structure 22 to a second similar attachment. A bolt 50 draws the clamp flange 54 toward the adjacent flange 42B. In a segmented CMC shroud ring, the clamp plate 52 forms a hoop that compresses the ring of CMC segments into stable end-to-end abutment, as described for FIG. 2.

Figure 4:
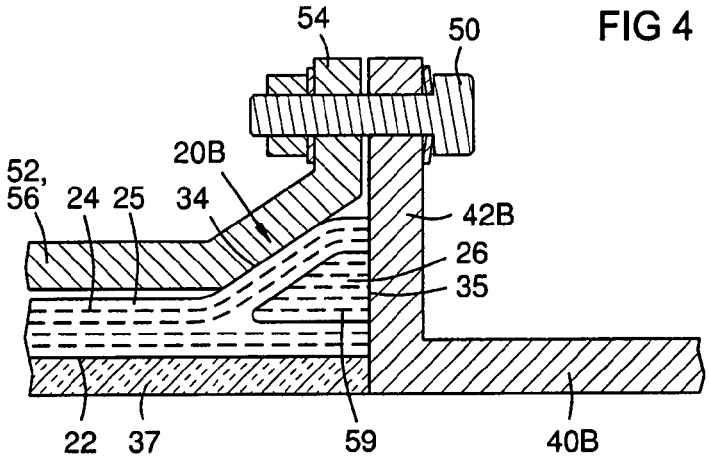
FIG. 4 is a sectional view of an alternative embodiment of a CMC flange attached as in FIG. 3.

FIG. 4 shows an embodiment of the CMC flange 20B, in which the block of additional ceramic material 26 is formed of additional CMC fabric layers 59 in a lay-up procedure, instead of as a monolithic block. The CMC fabric 24 of the wall structure 22 may be discontinuous around the block 26 as shown. This allows the wall structure 22 and the flange 20B to be formed by one or more lay-up steps without 3-dimensional weaving.

Figure 5:
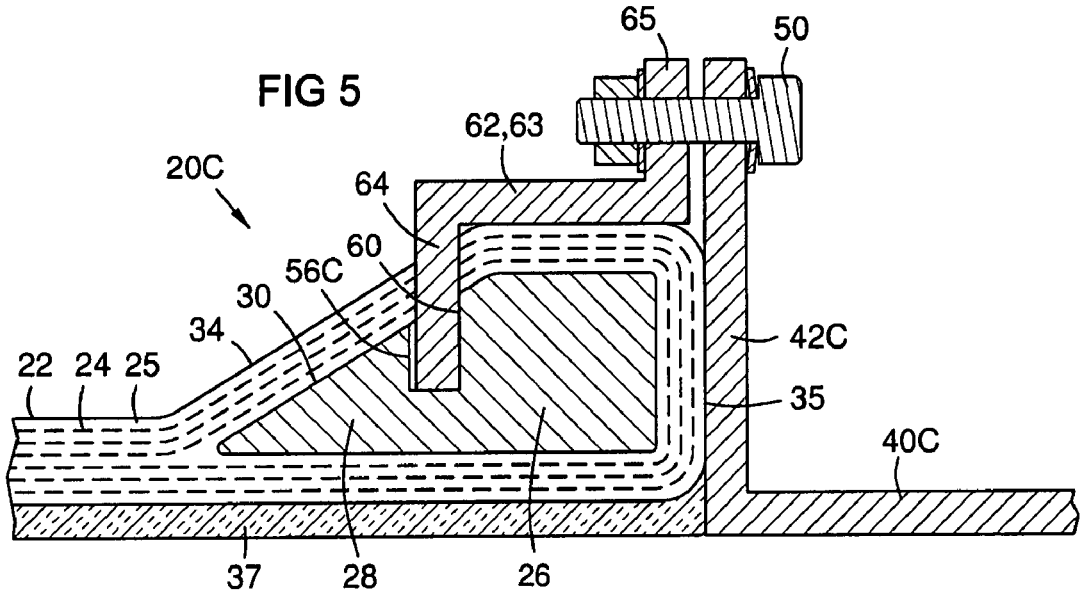
FIG. 5 is a sectional view of a CMC flange attached to an adjacent structure by means of a clamp bracket with hook.

FIG. 5 shows an embodiment 20C of the CMC flange attached to an adjacent structure 40C that has a flange 42C parallel with the outer face 35 of the flange 20C. An access port 56C is formed into the block 26, providing a contact face 60 parallel with the outer face 35. A clamp bracket 62 has a spanning portion 63, a hook portion 64, and a flange portion 65. A bolt 50 draws the flange portion 65 of the clamp bracket 62 toward the flange 42C of the adjacent structure 40C, thus holding the CMC wall structure 22 against the adjacent wall structure 40C. A spring washer may be provided on the bolt 50 to compensate for differential thermal expansion between the spanning portion 63 of the bracket 62 and the CMC flange 20C. Alternately, the bracket flange portion 65 may provide such elastic compensation.

Figure 6:
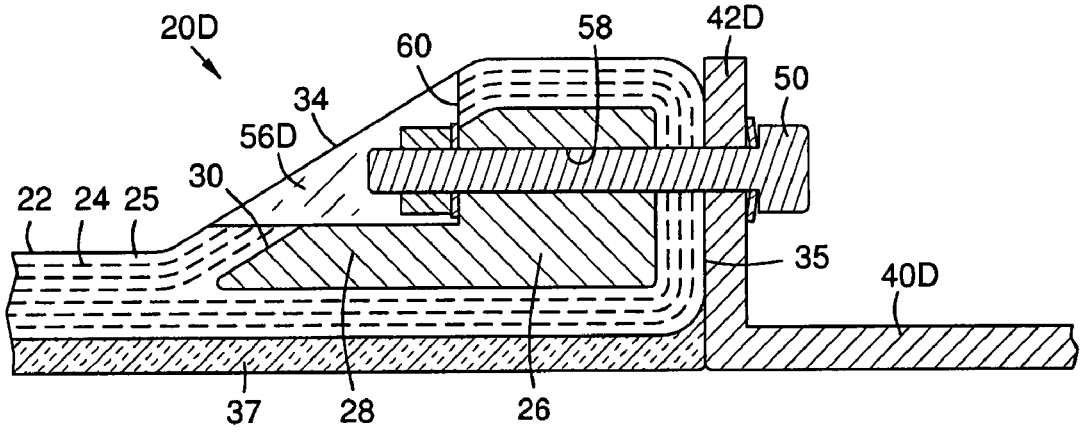
FIG. 6 is a sectional view of a CMC flange attached to an adjacent structure by means of a bolt through the flange core.

FIG. 6 shows an embodiment 20D of the CMC flange attached to an adjacent structure 40D that has a flange 42D. An access port 56D is formed into the block 26, providing a contact face 60 parallel with the outer face 35 of the flange 20D. A bolt hole 58 is formed from the access port 56D to the outer face 35 to admit the shaft of a bolt 50 that spans between the contact face 60 and the adjacent flange 42D. A spring washer may be provided on the bolt to compensate for differential thermal expansion between the bolt 50 and the CMC flange 20D. This embodiment does not require a ring shaped structure of the wall 22, since the bolt 50 fixes the flange 20D both laterally and vertically against the adjacent structure 40D. However, it can be also used in a ring-shaped structure.

Figure 7:
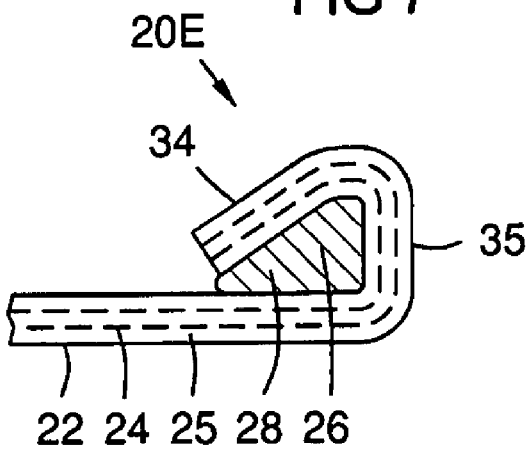
FIG. 7 is a sectional view of a CMC flange with a discontinuous wrap of CMC layers.
Figure 8:
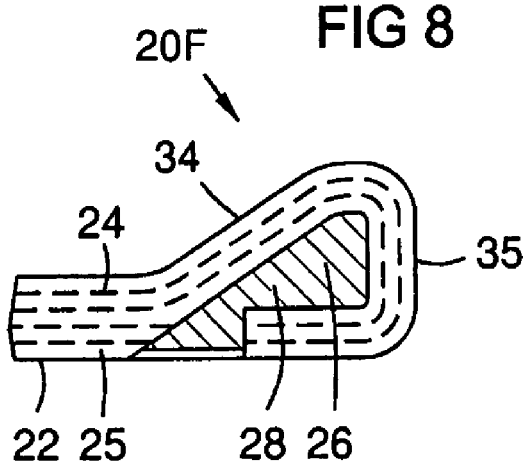
FIG. 8 is a sectional view of a CMC flange with a discontinuous wrap of CMC layers.
Figure 9:
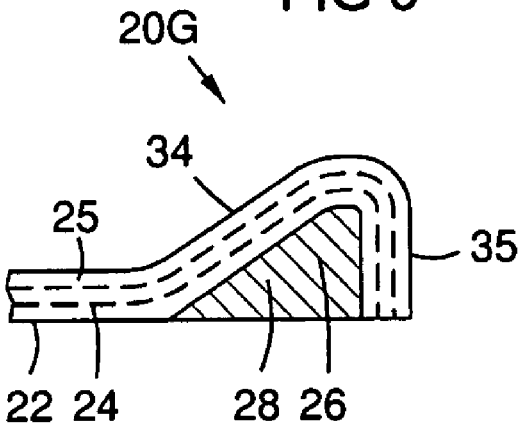
FIG. 9 is a sectional view of a CMC flange with a discontinuous wrap of CMC layers.

FIGS. 7-9 show embodiments of the CMC flange 20E, 20F, 20G with variations in a discontinuous wrap of the CMC fabric 24 over the block 26. These variations provide options for simplified lay-up, depending on the stress requirements of the application.

Figure 10:
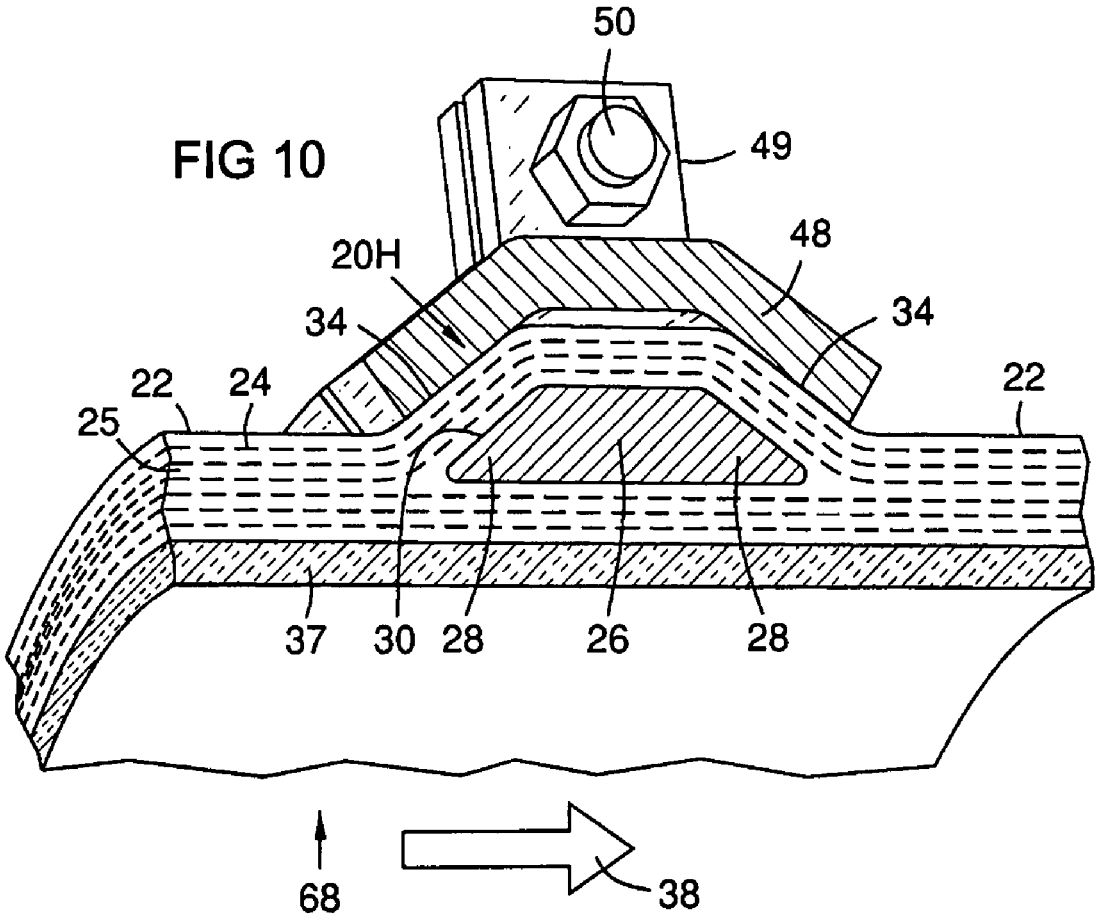
FIG. 10 is a sectional and perspective view of a shroud ring with a CMC flange at an axially intermediate position for clamping by a circular metal V-band.

FIG. 10 shows a sectional and perspective view of a CMC wall 22 formed as a shroud ring 68. A symmetric CMC flange 20H is formed at an axially intermediate position on the wall 22 using a ceramic block 26 with first and second symmetrically opposed generally wedge shaped portions 28. A circular metal V-band 48 may be clamped around the CMC flange 20H, providing metal attachment points to a further support structure not shown. This allows attachment of the CMC shroud ring 68 to metal structures without requiring holes in the CMC wall 22.

All embodiments except FIG. 4 eliminate CMC free edges in the gas path. Free edges of laminates are a site of high interlaminar stress and a source of interlaminar failure initiation. Wrapping of the fabric 24 around the blocks 26 avoids this. Even FIG. 4 alleviates this by distribution of stress throughout the thickness of the block 26 and flange 20B, thereby reducing interlaminar stress.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An attachment apparatus comprising:

a ceramic matrix composite (CMC) wall structure comprising a layer of CMC fabric impregnated with a ceramic matrix;

a block of additional ceramic material without holes attached to the CMC wall structure, the block comprising a generally wedge-shaped portion; and the layer of CMC fabric wrapped at least partly around the block of additional ceramic material and bonded thereto, forming an attachment flange with a core of the additional ceramic material;

wherein the block is attached along at least a portion of a peripheral edge of the CMC wall structure, the block comprises an oblique surface proximal to a geometric center of the CMC wall structure, and the attachment flange comprises an outer or distal face.

2. The apparatus claim 1 wherein the CMC fabric is formed continuously around the block of additional ceramic material.

3. The apparatus of claim 1 wherein the CMC wall structure forms a generally cylindrical portion of a gas turbine component, and the attachment flange is clamped to an adjacent hoop-shaped support structure.

4. The apparatus of claim 1 wherein the layer of CMC fabric covering the oblique surface of the block forms a first contact face for a circular V-band attachment, and a matching flange on an adjacent component comprises a second contact face for the V-band attachment; wherein the second contact face is symmetric with the first contact face about the distal face of the attachment flange.

5. The apparatus of claim 1 wherein the layer of CMC fabric covering the inner oblique surface of the block forms a contact face for a circular clamp plate, the clamp plate is attached to an adjacent component that abuts the outer face of the attachment flange, the clamp plate spans to a second edge of the CMC wall structure opposite said peripheral edge, and the clamp plate is attached to a second adjacent component abutting said second edge.

6. The apparatus of claim 1 wherein the CMC fabric is formed discontinuously around the block of additional ceramic material.

7. A method for attaching a ceramic matrix composite (CMC) component to an adjacent structure, comprising:

forming a CMC wall structure comprising a layer of CMC fabric impregnated with a ceramic matrix;

attaching a block of additional ceramic material to the CMC wall structure, the block comprising a generally wedge-shaped portion; and wrapping the layer of CMC fabric at least partly around the block of additional ceramic material, thus forming an attachment flange with a core of the additional ceramic material;

wherein the block is attached along at least a portion of a peripheral edge of the CMC wall structure, the block comprises a surface that is oblique relative to the CMC wall structure and is proximal to a geometric center of the CMC wall structure, and the attachment flange comprises an outer or distal face substantially normal to the CMC wall structure;

wherein the layer of CMC fabric covering the oblique surface of the block forms a first contact face for a circular V-band attachment, and a matching flange on an adjacent component comprises a second contact face for the V-band attachment;

wherein the second contact face is symmetric with the first contact face about the distal face of the attachment flange.

8. The attachment method of claim 7 wherein the CMC fabric is formed continuously around the block of additional ceramic material.

9. The attachment method of claim 7 wherein the CMC wall structure forms a generally cylindrical portion of a gas turbine component, and the attachment flange is clamped to an adjacent hoop-shaped support structure.

10. The attachment method of claim 7 wherein the layer of CMC fabric covering the oblique surface of the block forms a contact face for a circular clamp plate, the clamp plate is attached to an adjacent component that abuts the outer face of the attachment flange, the clamp plate spans to a second edge of the CMC wall structure opposite said peripheral edge, and the clamp plate is further attached to a second adjacent component abutting said second edge.

11. The attachment method of claim 7 wherein an access port is formed into the block, the access port comprises an inner face substantially parallel to the outer face of the attachment flange, a clamp bracket is attached to an adjacent component that abuts the outer face of the attachment flange, and a hook on the clamp bracket contacts the inner face of the access port in the block.

12. The attachment method of claim 7 wherein an access port is formed into the block, the access port comprises an inner face substantially parallel to the outer face of the attachment flange, and further comprising a hole between the inner face of the access port and the outer face of the attachment flange for admitting a fastener spanning between the inner face of the access port and an adjacent component that abuts the outer face of the attachment flange.

13. The attachment method of claim 7 wherein the CMC fabric is formed discontinuously around the block of additional ceramic material.

14. An attachment apparatus comprising:

a ceramic matrix composite (CMC) wall structure without holes, comprising a layer of CMC fabric impregnated with a ceramic matrix;

a block of additional ceramic material attached to the CMC wall structure, the block comprising a generally wedge-shaped portion;

the layer of CMC fabric wrapped at least partly around the block of additional ceramic material and bonded thereto, forming an attachment flange with a core of the additional ceramic material;

wherein the CMC wall structure forms a generally cylindrical ring;

wherein the attachment flange is formed at an axially intermediate position on a radially outer surface of the CMC wall structure;

wherein the block of additional ceramic material comprises first and second symmetrically opposed generally wedge-shaped portions; and wherein a circular metal V-band is clamped around the attachment flange, thus attaching the metal V-band to the CMC wall structure.

* * * * *